United States Patent [19]

Takano

[11] 4,044,212

[45] Aug. 23, 1977

[54] ELECTRIC SWITCHES AND PROCESS AND APPARATUS FOR MANUFACTURE THEREOF

[76] Inventor: Tetsuo Takano, Tachihongo 446, Yatsuomachi, Nei, Toyama, Japan

[21] Appl. No.: 615,600

[22] Filed: Sept. 22, 1975

Related U.S. Application Data

[63] Continuation of Ser. No. 399,681, Sept. 24, 1973, abandoned.

[30] Foreign Application Priority Data

| | | |
|---|---|---|
| Sept. 26, 1972 | Japan | 47-96402 |
| Apr. 26, 1973 | Japan | 48-51324 |
| July 24, 1973 | Japan | 48-82680 |

[51] Int. Cl.[2] ..... H01H 3/00

[52] U.S. Cl. ..... 200/283; 200/67 D; 200/275

[58] Field of Search ..... 29/630 C; 200/670, 246, 200/283, 284, 275

[56] References Cited

U.S. PATENT DOCUMENTS

| | | | |
|---|---|---|---|
| 2,659,238 | 11/1973 | Martin | 200/67 D |
| 2,984,893 | 5/1961 | Spooner | 29/630 C |
| 3,164,708 | 1/1965 | Theobald | 29/630 C |
| 3,263,306 | 8/1966 | Chapin et al. | 29/630 C |

FOREIGN PATENT DOCUMENTS

| | | | |
|---|---|---|---|
| 737,998 | 10/1955 | United Kingdom | 29/630 D |

*Primary Examiner*—David Smith, Jr.
*Attorney, Agent, or Firm*—Oblon, Fisher, Spivak, McClelland & Maier

[57] ABSTRACT

A strip of electroconductive material is perforated by I-shaped holes. Contact materials shaped to conform to said I-shaped holes are inserted in the holes and caulked. Then, the I-shaped contact materials are perforated across the middle thereof in conjuction with the adjoining portions of the electroconductive material so as to divide each contact material into two contacts separated by a contact gap formed therebetween. A leaf spring fitted at one end thereof with a movable contact intended for insertion into said contact gap is held in position, though not in an immobilized state, with the other end thereof simply inserted around the stem of a spring support. Terminals which are retained in their fixed relative position by means of a webbing interconnecting them are fastened with adhesive agent to a plastic case. After the fastening, said webbing is cut off.

1 Claim, 24 Drawing Figures

G
F
25
26
P'
H
P

G
F
25
26
P'
H
P

E
E'

F
28
27
26
H

F
H

E
22
23
24
21
21

ELECTRIC SWITCHES AND PROCESS AND APPARATUS FOR MANUFACTURE THEREOF

This is a continuation of application Ser. No. 399,681, filed Sept. 24, 1973, now abandoned.

BACKGROUND OF THE INVENTION

This invention relates to electric switches of the type which have an opposed pair of stationary contacts and a movable contact and are fabricated by pressing, to an apparatus for the manufacture thereof and to a process for said manufacture.

The quality and performance of electric switches have no little effect upon the quality of various electric appliances which these switches serve. In an extreme case, failure in an electric switch can even endanger the safety of a person handling the electric appliance containing that switch. All the electric switches are, therefore, required to possess stable quality, provide quick operation and preclude troubles. For this reason, ordinary electric switches currently manufactured require much time and labor in jobs of inspection and possible readjustment which are performed subsequent to conclusion of the assembly of parts. U.S. Pat. No. 3,189,703 has issued to an invention which relates to a method for providing epochal improvements in the manufacture of electric switches. It provides a method which comprises the steps of punching sets each of three terminals in an interconnected form out of a strip of electroconductive material, mounting on each set an opposed pair of stationary contacts and a leaf spring fitted with a movable contact, embedding them with a molded plastic webbing and thereafter removing the webbing temporarily interconnecting the three terminals. This invention is excellent in that there is no possibility of dimensional error because the three terminals and the conductor are always retained in their relative position acquired at the time of punching and that the switches are suitable for mass-production. Nevertheless, the work of mounting a leaf spring and an opposed pair of contacts on such terminals which are manufactured efficiently by the method of said U.S. patent is not efficient. Particularly, the stationary contacts are formed by a troublesome step of mounting two prefabricated mushroom-shaped silver contacts in the slots and peening the divergent portion of the contact at predetermined positions into the slot. Contacts of the type formed by pressing silver rods into hemicircular slots are not totally reliable in terms of joint strength and electroconductivity. Worse yet, the very low dimensional accuracy of contact gap poses itself as a serious problem.

According to said U.S. patent, each unit of interconnected terminals is embedded by molded plastic webbing. Inclusion of such troublesome and inefficient molding work in the process of switch production can hardly be regarded as an improvement.

The main object of the present invention is to provide electric switches which are suitable for mass-production and which enjoy so precise fabrication as to render the jobs of inspection and readjustment practically unnecessary.

Another object of this invention is to provide electric switches each possessed of an opposed pair of contacts, completed by a sole operation of pressing using a strip of contact material such as of silver which is fed to the electric switch production line.

Still another object of this invention is to provide a process for completing high-quality stationary contacts in electric switches by a sole operation of pressing using a strip of contact material such as of silver.

Yet another object of this invention is to provide electric switches which are completed by a sole operation of pressing using a strip of contact material such as of silver and subsequently enclosed in prefabricated cases with high efficiency.

Another object of this invention is to provide electric switches which, on account of a leaf spring fitted at one end thereof with a movable contact and mounted on the other end thereof around the neck of a common inner end of terminals, enjoy sharp snap action and durability and which, at the same time, enjoy freedom from a conventional disadvantage that the snap action is adversely affected by the degree with which the spring is fastened.

SUMMARY OF THE INVENTION

In electric switches of the type having an opposed pair of stationary contacts and a movable contact adapted to snap into touch alternately with said two stationary contacts, the electric switches which accomplish the aforementioned objects of the present invention have parallelly opposed faces of a sheet conductor lying in one plane and an opposed pair of stationary contacts completely set flush into the respective slots formed inwardly from said opposed faces, said two contacts being caulked onto the edge of said slots by means of pressure exerted in a direction perpendicular to the sheet conductor and said opposed faces of said two contacts being subjected to the treatment of shaving subsequent to having a hole punched out so as to form a contact gap in conjunction with said opposed faces of sheet conductor.

This invention is particularly effective when it is practiced in the following manner.

This invention is applied to an electric switch of the type in which the conductor unit excluding the leaf spring fitted with a movable contact is wholly formed by being punched out of one sheet conductor by the operation of pressing and therefore it lies in one plane; the leaf spring fitted with a movable contact is inserted around the spring support disposed at the base of the common terminal so that it is allowed to move upward and downward with the spring support as a fulcrum; the terminals of the electric switch wholly punched out of one metal strip as mentioned above are fastened with adhesive agent to at least one of the two segments composing a separately formed switch case and, after this fastening, the webbing which has been left unpunched for the purpose of temporarily interconnecting the terminals is cut off; and the upper and lower right-angled corners of the slots formed inwardly from the opposed faces of a sheet conductor are sloped in advance by the pressure of a punch.

The process for the manufacture of electric switches according to the present invention essentially comprises the steps of punching I-shaped holes through a sheet conductor, forming contact pieces substantially conforming to said I-shaped holes by punching from a strip of contact material, inserting said contact pieces under pressure into said I-shaped holes, caulking the contact pieces both upwardly and downwardly, subsequently perforating the I-shaped contact pieces across the middle thereof in conjunction with the adjoining portion of the surrounding sheet conductor for thereby forming contact gaps and finishing the opposed faces of resultant paired contacts by the treatment of shaving effected by a means of pressing.

The apparatus for the manufacture of electric switches according to the present invention comprises, in combination, a means for feeding a strip of electroconductive material, a press for stamping said strip, a punch and a die for punching an I-shaped hole in said strip, a means for forwarding a strip of contact material into a position directly above said I-shaped hole, a die for punching a contact piece conforming to said I-shaped hole out of said strip of contact material, a punch serving to cause the contact piece just cut out of the strip to be forced into said I-shaped hole underneath, an anvil for holding the strip of electroconductive material in position for said I-shaped contact piece to be caulked subsequent to insertion in the hole, a punch and a die for punching a hole across the middle of said I-shaped contact piece in conjunction with the adjoining portion of the surrounding electroconductive material, a means adapted to effect the treatment of shaving on the opposed faces of resultant contacts separated by a gap and a means for punching the unnecessary portion of the electroconductive material so as to form conductors and terminals.

The term "I-shaped" as used herein is a generic name for referring collectively to all the forms in which an opposed pair of contacts are to be obtained from one contact piece.

Other objects and other features of the present invention will become apparent from the description to be given in further detail herein after with reference to the accompanying drawings.

DETAILED DESCRIPTION OF THE INVENTION

Figure 1:
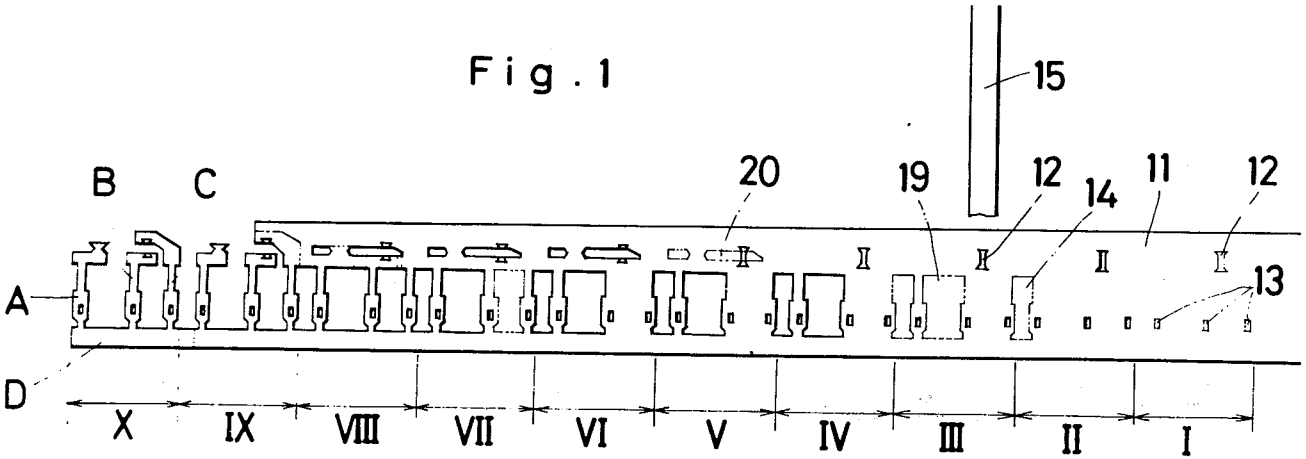
FIG. 1 is an explanatory diagram illustrating one preferred embodiment of the process for the fabrication of electric switches according to the present invention.
Figure 10:
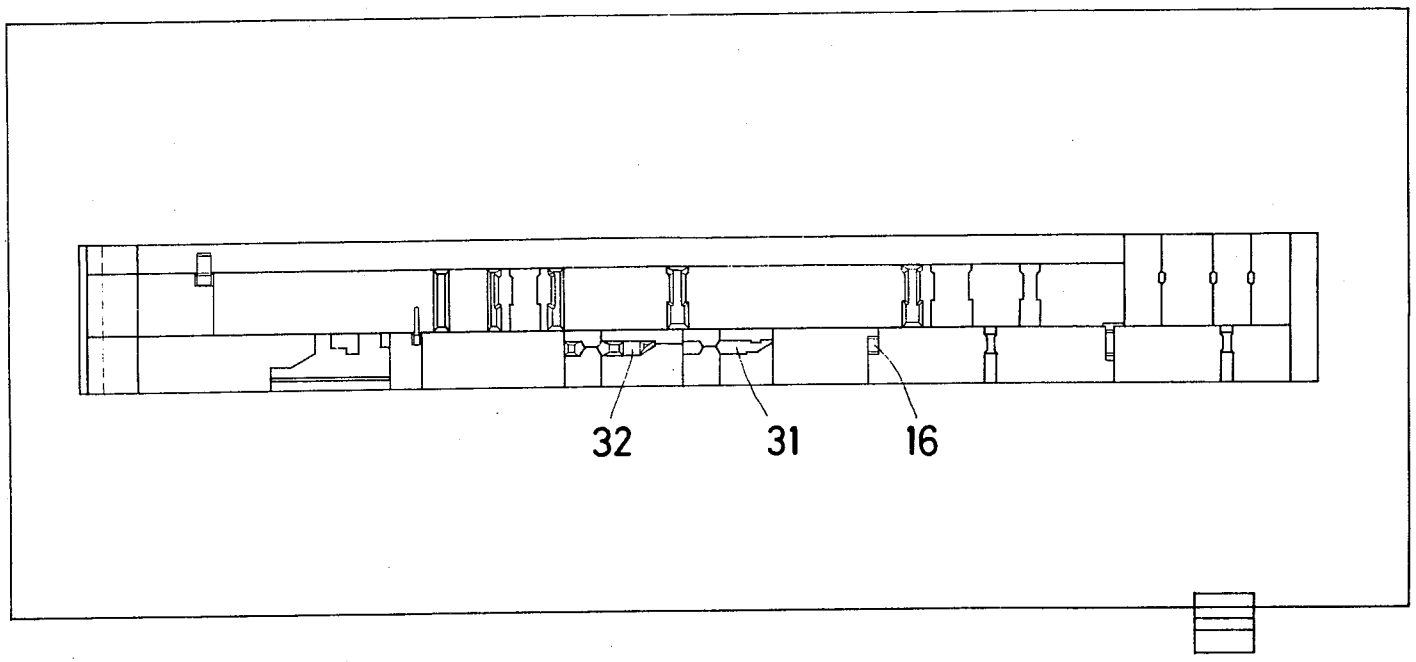
FIGS. 10 and 11 are plan views illustrating one preferred embodiment of a set of upper and lower continuous dies to be used for the operation line of FIG. 1.
Figure 11:
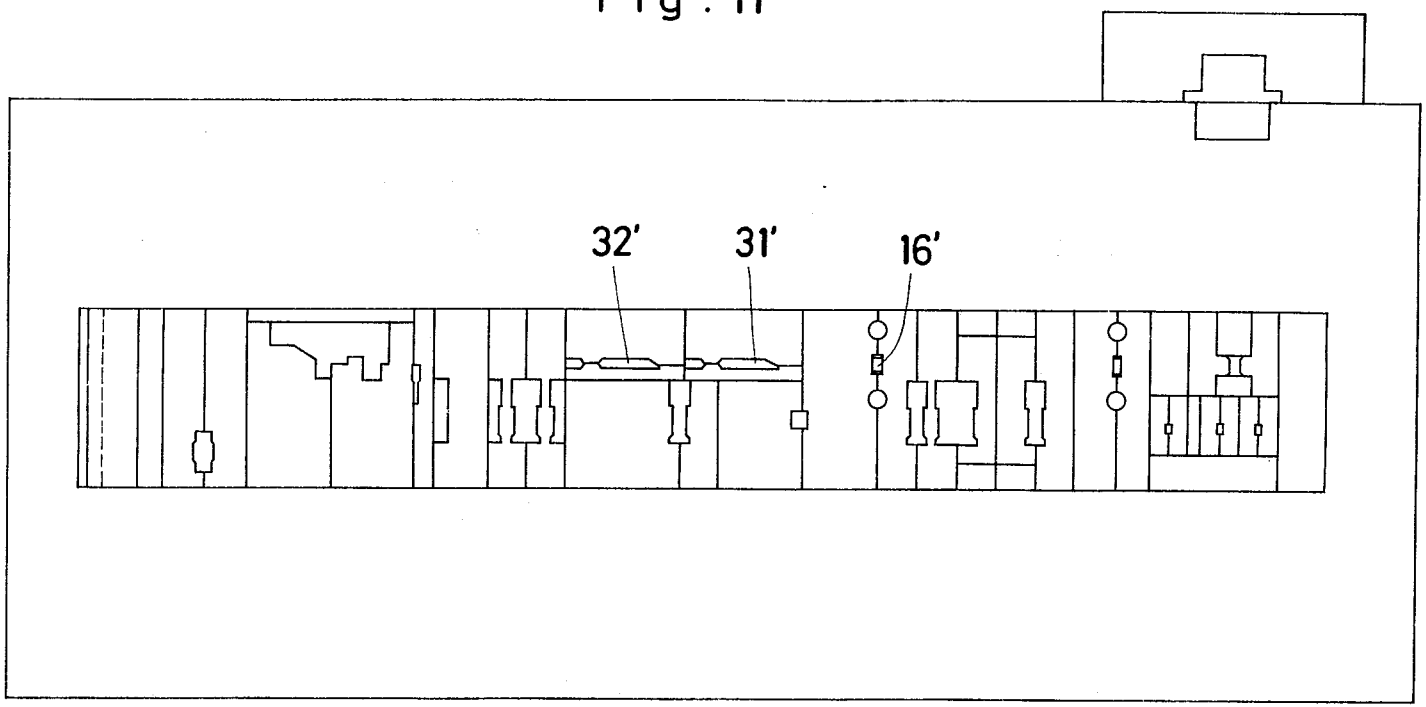

FIG. 1 is an explanatory diagram illustrating the process for the fabrication of electric switches according to this invention. In this process, nine successive presses each fitted with a punch and a die are operated to perform gradually advanced steps of fabrication on a strip of sheet 11 as it is advanced one block at a time. The preferred embodiment illustrated in this diagram represents a case in which a strip of electroconductive material is forwarded one block at a time to undergo one step of fabrication after another in the sequence of operation. To be more practical, one press fitted with upper dies and lower dies like the ones illustrated in FIGS. 10 and 11 is operated and, after each stroke of the press, either the paired dies or the strip of electroconductive material being worked on is moved one block at a time for the next punch stroke.

Figure 2:
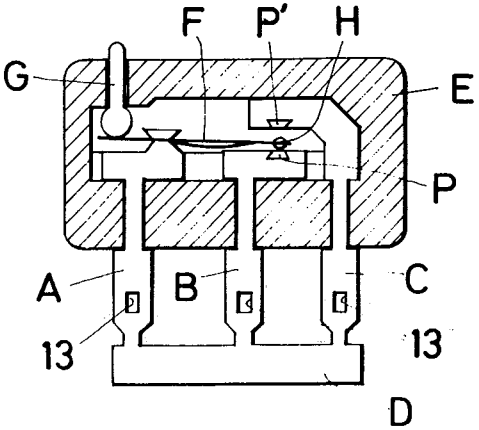
FIG. 2 is a plan view illustrating an electric switch embedded in one of the two segments composing a prefabricated plastic case, said electric switch having terminals interconnected by a webbing as obtained in the leftmost block of the strip of successive blocks shown in FIG. 1, with a leaf spring inserted in position therein.
Figure 3:
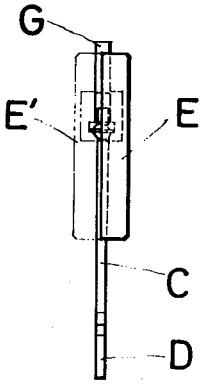
FIG. 3 is a side elevation of said electric switch enclosed completely in a prefabricated plastic case.
Figure 4:
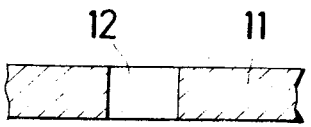
FIG. 4 is a cross-sectional view illustrating a metal strip having a hole perforated for insertion of a silver piece as a contact material.
Figure 17:
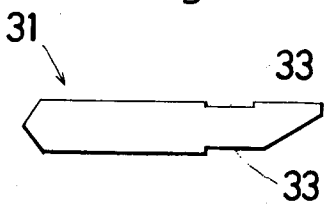
FIGS. 17 and 18 are a plan and a side view respectively of a punch to be used for splitting the silver piece 15'.
Figure 18:
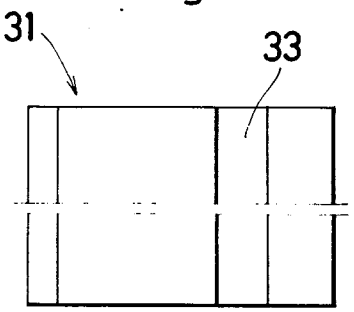

The strip 11 made of copper alloy measures 21 mm in width and 0.8 mm in thickness and is divided into blocks of a unit length of 20 mm. The Roman numerals I through X placed in the drawing under the lower edge of the strip are serial numbers indicating the sequence of fabrication. The strip of silver used as the contact material has a width of 5.0 mm and the same thickness 0.8 mm as that of said strip 11 and it is fed in by a pitch of 5 mm. Principal devices and tools which are used in this production line will be described. As a matter of course, a press and means for advancing the strip of electroconductive material 11 and the strip of silver 15 are indispensable. They are commonplace devices so common to the operation of pressing that they are understood without the aid of diagrammatic illustration. In the first step, a punch 30 and a die 30' adapted to punch the I-shaped hole as illustrated in FIGS. 10 and 11 are used. The third step requires the use of a feeding means adapted to forward the strip of contact material 15 usually of silver onto said I-shaped hole 12 in a direction perpendicular to the strip 11, a die 16' (FIGS. 6 and 11) for punching an I-shaped contact material out of said silver strip 15 and a punch 16 serving to push the contact material 15' immediately into the I-shaped hole 12 underneath. In the fourth step, there is used an anvil which is placed underneath for the contact material 15' pushed into position in the hole to be caulked. In the fifth step are used a punch 31 and a die 31' (FIGS. 17 and 18) which are adapted to punch an elongate hole 20 across the I-shaped contact material 15' in the middle as illustrated in FIGS. 9 and 10. A punch 32 and a die 32' (FIGS. 19 and 20) adapted to shape the opposing faces of the contacts are used in the sixth step. In the seventh through ninth steps are used punches and dies which serve to punch unnecessary portions out of the strip 11. For the tenth and last step, there is required a conveying means which is adapted to forward terminals interconnected with a webbing to a storage or to an assembling line. The individual steps of fabrication involved herein will be described. In the first step, the I-shaped hole 12 having its top and bottom ends at positions at which the opposed pair of stationary contacts P and P' are expected to fall (FIG. 2) is punched out. In the illustrated embodiment, the top and bottom ends of the I-shaped hole are protruded in the shape of "serifs" but these protrusions may be omitted as circumstances require. At the same time, a hole 13 is punched through each of the terminals A, B and C (FIG. 2) for facilitating guidance. At this stage, the I-shaped hole, of course, has a rectangular cross section as shown in FIG. 4. If this cross section was left in its unaltered form, then the silver piece to be inserted in the hole would have freedom of movement in the vertical direction. To prevent this movement, therefore, the upper and lower right-angled corners of the hole are sloped by pressing in the second step. At the same time, a hole 14 is punched out in a pattern such that individual terminals separated from one another are formed.

Figure 6:
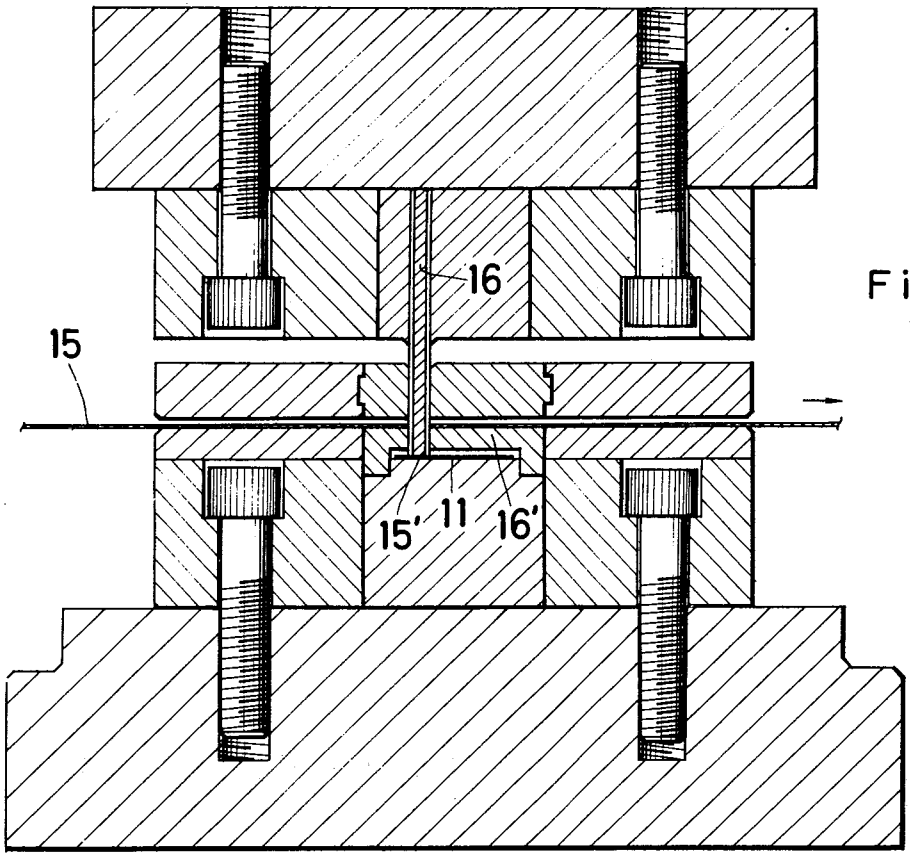
FIG. 6 shows Step III of the series of steps shown in FIG. 1, wherein a silver piece 15' is punched out of a strip of silver 15 and immediately pushed into the hole 12 punched in advance in the strip 11.

In the third step, the strip of silver 15 forwarded in a direction perpendicularly to the strip of electroconductive material 11 is led to the punch die 16' placed directly above the I-shaped hole 12 as shown in FIG. 6. By means of the punch 16, a piece of silver having a shape exactly conforming to or only slightly larger than the I-shaped hole 12 is punched out of the silver strip 15 and immediately pushed into the I-shaped hole. Since the hole 12 is held on the anvil, the punch 16 may be so operated as to provude a slight caulking motion on the silver piece 15' against the I-shaped hole 12. In this step, the hole 19 is simultaneously punched out to form an opening between the terminals A and B.

Figure 8A:
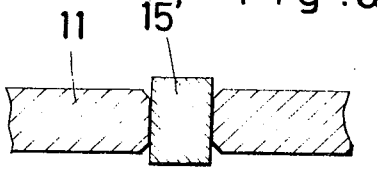
FIGS. 8(A) and (B) are explanatory diagrams illustrating the same step wherein the silver piece 15' of an increased height is caulked to the hold.
Figure 8B:
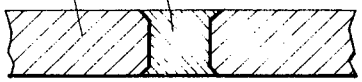
Figure 7A:
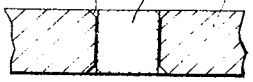
FIGS. 7(A) and (B) are explanatory diagrams illustrating a step wherein the silver piece 15' is inserted in the hole 12 and immediately caulked with force exerted on the upper and lower ends thereof.
Figure 7B:
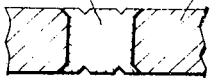

In the fourth step, the silver piece 15' which has been pushed in position during the preceding step is caulked both upwardly and downwardly as illustrated in FIGS. 7(A) and (B) or FIGS. 8(A) and (B), depending on the height of the silver piece. FIG. 7 represents a case in which both the silver piece 15' and the strip of electroconductive material 11 have a common thickness of 0.8 mm. Here, the upper and lower peripheries of the silver piece 15' are caulked so that they are extended to cover up the upper and lower sloped edges of the I-shaped hole formed during the second step. This caulking is accomplished by moving a pair of wedge-shaped punches toward each other to exert pressure along the peripheries. Where the silver piece used as the contact material has a smaller diameter, the caulking may be effected by exerting pressure on the centers of the silver piece instead of the peripheries. As a result of the caulking, the silver piece 15' and the strip 11 are joined securely and, at the same time, there is formed a contact plane of low electric resistance. In the case of a silver piece 15' having a greater thickness than that of the strip 11, the silver piece 15' is only required to be crushed as illustrated in FIG. 8. Consequently, the silver piece 15' is deformed so as to conform to the hole in much the same way as a rivet is flattened into a joining position, i.e., from the shape of (A) to that of (B) of the drawing. In this case, the third step may be performed so as to effect the required caulking of the silver piece 15' simultaneously with the insertion thereof in the I-shaped hole instead of incorporating the fourth step exclusively for the purpose of caulking. Since the operation of caulking tends to force the surrounding material outwardly, it is performed prior to the shaping of terminals A, B and C to prevent otherwise possible dimensional error in the finished product.

Figure 9A:
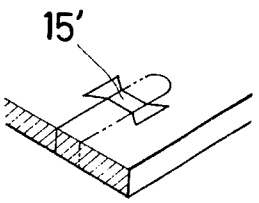
FIGS. 9(A) and (B) are explanatory diagrams illustrating a step wherein an elongate hole 20 intersecting the silver piece 15' at the middle and extending into the adjoining portion of the surrounding electroconductive material is punched out so as to split the silver piece 15' in the middle.
Figure 9B:
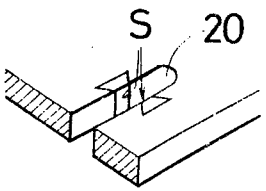
Figure 5:
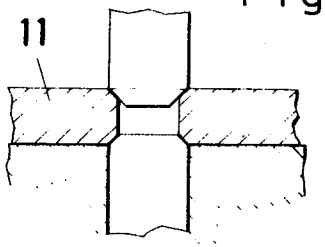
FIG. 5 is a cross-sectional view illustrating the same strip having the upper and lower right-angled corners of said hole sloped under pressure.

In the fifth step, an elongate hole 20 containing a gap to be inserted between the opposed pair of contacts is punched out as illustrated in FIG. 9(A) and (B). This perforation results in shaping an opposed pair of silver contacts P and P' (FIG. 2) as surrounded on all sides except the punched side by the copper alloy material.

Figure 19:
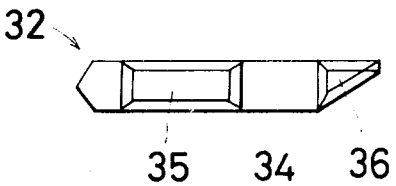
FIGS. 19 and 20 are a plan and a side view respectively of a punch to be used for the operation of shaving.
Figure 20:
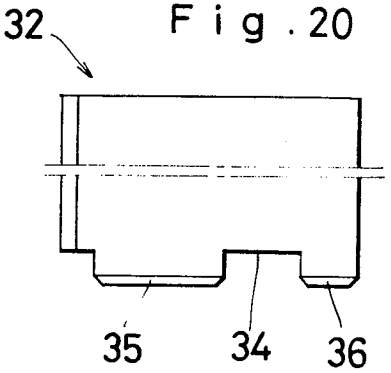

In the sixth step, the opposed faces of the contacts confronting each other across the gap-forming hole 20 are subjected to a shaving treatment to have the silver contacts finished in smooth surface and, at the same time, adjust the contact gap to a predetermined size. As is evident from FIG. 17, the punch 31 which is used for punching the hole 20 across the silver piece 15' has a shape such that a margin of 0.08 mm for shaving is allowed to remain on the portion 33. Precise finishing of the silver contacts for smooth surface and accurate gap is accomplished by shaving said margin by means of the shaving punch 32 (FIGS. 19 and 20). The proper thickness of this margin for shaving is on the order of 10% of the thickness of the strip 11. The shaving punch and the die are not allowed to have any clearance. The two protuberances 35 and 36 at the lower end of the shaving punch illustrated in FIGS. 19 and 20 serve as guides. They slide along the holes formed by the punch of FIGS. 17 and 18 and guide the shaving portion 34 of the punch 32 correctly.

The steps so far described complete the essential part of contact fabrication. In the seventh and eighth steps, a hole for separating the terminals is punched out and unnecessary portions of the strip are removed by punching. The cutting and punching operation performed in the ninth step gives rise to a three-terminal block as a unitary piece. This block is taken out in the tenth step.

The three terminals A, B and C which constitute the conductor portion except for the leaf spring F are retained in their fixed relative position by means of a strong webbing D. In the meantime, switch cases each incorporating three grooves for receiving the three terminals A, B and C, a stepped portion 22 for immobilizing the terminals when the terminals are encased between upper and lower segments of the case, a cavity 23 to permit the movable contact H and the leaf spring F serving said movable contact H to have freedom of movement within the case, and a groove 24 for receiving the push rod G and permitting vertical movement of said push rod are massproduced by using a suitable plastic material. In the illustrated preferred embodiment, the grooves 21 for receiving the terminals and the stepped portion 22 for immobilizing the terminals are formed on only one of the two segments E and E' of each case. The two segments E and E' may be formed in perfect symmetry if circumstances require.

Figures 12, 13, 14A, 14B, 15, 16:
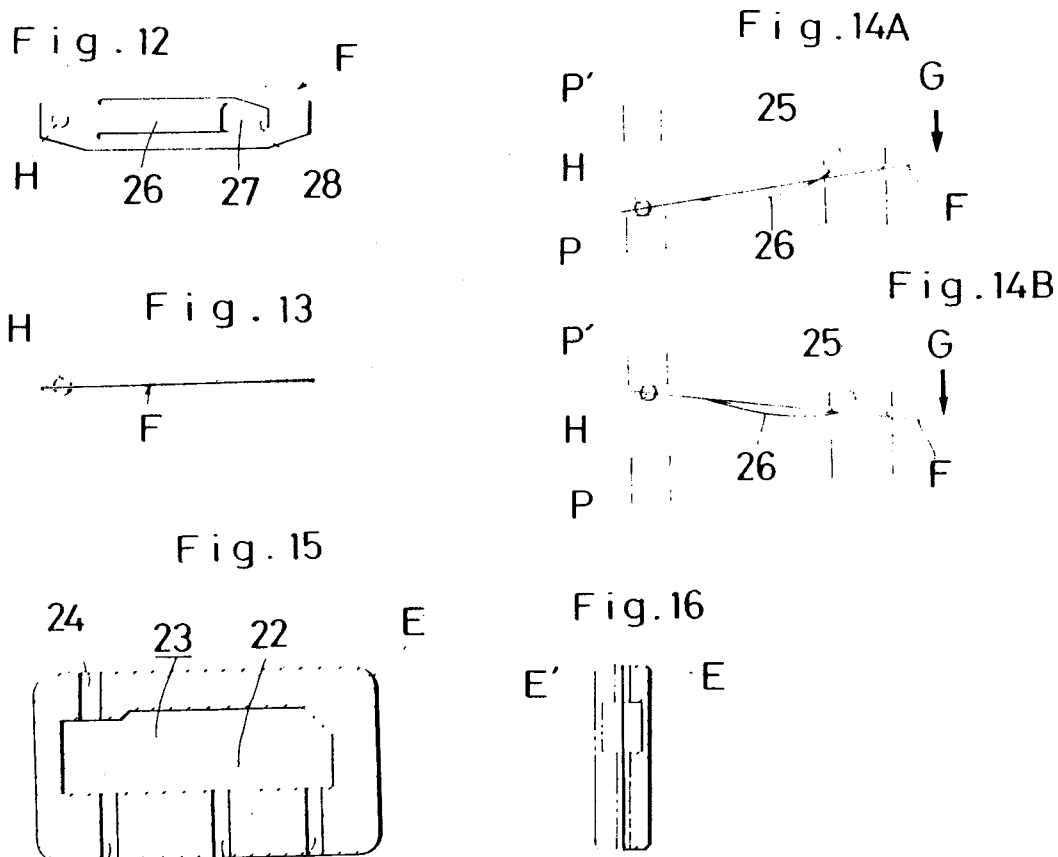
FIG. 12 is a plan view of a leaf spring F.
FIG. 13 is a side view of said leaf spring F.
FIGS. 14(A) and (B) are explanatory diagrams illustrating the function of the leaf spring F.
FIGS. 15 and 16 are a plan and a cross-sectional view illustrating one preferred embodiment of a plastic case to which the series of terminals shaped by the operation of pressing are joined with adhesive agent.

The leaf spring F must be mounted on the spring support 25 at the base of the terminal A before the switch is encased securely in the case with the aid of adhesive agent. From the practical point of view, this operation of encasing is more advantageously performed manually. The leaf spring F of a special design illustrated in FIGS. 12 and 13 is mounted by slightly bending the tongue 26 so as to widen the gap 27 and, in that state, simply hooking it on the neck of the spring support 25 of the terminal A. Thus, the work of assembly is easy and the spring of the finished switch enjoys uniform performance. Leaf spring F can be punched out of a strip of spring material and therefore is suitable for mass production. Total absence of bending treatment serves the purpose of precluding possible inconsistency of spring performance ascribable to the operation of bending. Of course, this also contributes to decreasing the production cost.

The interconnected terminals A, B and C having the leaf spring F inserted around the spring support 25 are set in position, in conjunction with the push rod G, in the respective grooves formed in the switch case. Unlike the conventional switch case, the groove width of the present switch case has nothing to do with the regulation of the relative position of the terminals. Therefore, the grooves may be formed with ample width so as to facilitate insertion of the terminals. The relative position of these terminals is retained first with an interconnecting webbing D and then, after removal of the webbing, with the adhesive agent with which the switch has been fastened to the case interior. This applies to the case of a small switch, in which the upper and lower segments of a switch case are permanently fastened together with adhesive agent. If circumstances require, however, the switch may be fastened to only one of the two segments so that the switch case may be opened. It should be understood that the present invention is not limited to the aforementioned preferred embodiment wherein all the terminals in a switch unit are punched out as a unitary piece by pressing but is applicable to all electric switches using an opposed pair of contacts and similar electric switches. All these applications are, therefore, covered by the scope of this invention.

What is claimed is:

1. An electrical switch comprising:

a first terminal of conductive material having an elongated portion and an end portion, the end portion having first and second indentations therein on opposite sides thereof to serve as a spring support, a second terminal of conductive material disposed adjacent to the first terminal and having an elongated portion and an end portion, the end portion having a groove therein, an electrical contact disposed within the groove of the second terminal to be flush with the second terminal and not to project therefrom, a third terminal of conductive material disposed adjacent to the second terminal and having an elongated portion and an end portion, the end portion having a groove therein, an electrical contact disposed within the groove of the third terminal to be flush with the third terminal and not to project therefrom, the end portion of the third terminal being disposed opposite to the end portion of the second terminal so that the electrical contact of the second terminal is disposed opposite to the electrical contact of the third terminal, an elongated leaf spring having outer and inner integrally formed portions with an opening therebetween having the first terminal passing therethrough, one end of the inner spring portion being disposed within the first indentation of the first terminal and an internal end of the outer spring portion being disposed within the second indentation of the first terminal, an electrical contact disposed at an end of the leaf spring so as to lie between the contact of the second terminal and the contact of the third terminal, a push rod disposed to abut the end of the leaf spring opposite to the end having the electrical contact to move the electrical contact between the contacts of the first and second terminals, a switch case for receiving the push rod, the first, second and third terminals and the leaf spring comprising first, second and third grooves for receiving the elongated portions of the first, second and third terminals, a stepped portion for immobilizing the first, second and third terminals, a groove for receiving the push rod and permitting movement thereof in only two opposite directions and a cavity to permit movement of the leaf spring.

* * * * *